US008942589B2

(12) United States Patent
Asami et al.

(10) Patent No.: US 8,942,589 B2
(45) Date of Patent: Jan. 27, 2015

(54) FIXING APPARATUS

(71) Applicant: Canon Kabushiki Kaisha, Tokyo (JP)

(72) Inventors: Jun Asami, Susono (JP); Toshiya Kaino, Suntou-gun (JP); Taisuke Minagawa, Mishima (JP); Koji Nihonyanagi, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 3 days.

(21) Appl. No.: 13/752,742

(22) Filed: Jan. 29, 2013

(65) Prior Publication Data

US 2013/0195494 A1 Aug. 1, 2013

(30) Foreign Application Priority Data

Jan. 31, 2012 (JP) ..... 2012-018916

(51) Int. Cl.
*G03G 15/20* (2006.01)

(52) U.S. Cl.
CPC ..... *G03G 15/2078* (2013.01); *G03G 15/2042* (2013.01); *G03G 15/2053* (2013.01); *G03G 2215/2035* (2013.01)
USPC ..... 399/70; 399/328; 399/329; 399/331; 219/216

(58) Field of Classification Search
USPC ..... 399/69, 70, 320, 328, 329, 331, 334; 219/216
See application file for complete search history.

(56) References Cited

U.S. PATENT DOCUMENTS

| | | | | |
|---|---|---|---|---|
| 5,464,964 | A * | 11/1995 | Okuda et al. | 219/497 |
| 6,823,150 | B1 * | 11/2004 | Cao et al. | 399/69 |
| 2005/0117930 | A1 * | 6/2005 | Akizuki et al. | 399/69 |
| 2012/0269533 | A1 * | 10/2012 | Wakide et al. | 399/69 |
| 2012/0308253 | A1 * | 12/2012 | Kurata et al. | 399/69 |

FOREIGN PATENT DOCUMENTS

| | | | |
|---|---|---|---|
| JP | 2005-195856 | A | 7/2005 |
| JP | 2006-215143 | A | 8/2006 |
| JP | 2007-114669 | A | 5/2007 |
| JP | 2010-102109 | A | 5/2010 |

* cited by examiner

*Primary Examiner* — Francis Gray
(74) *Attorney, Agent, or Firm* — Canon U.S.A., Inc. IP Division

(57) ABSTRACT

A fixing apparatus includes a film, a heater that contacts the inner face of the film and is capable of changing heat distribution, and a pressure member that forms the nip portion with the heater via the film, the pressure member including a region on which a diameter is increased from a center portion toward an end portion, wherein the fixing apparatus performs heater control so that a ratio of an amount of heat generation at the end portion of the heater to an amount of heat generation at the center portion of the heater is changed based on a temperature of the end portion of the pressure member, during a period at least from when the warm-up of the fixing apparatus is started until the recording material reaches the nip portion.

9 Claims, 11 Drawing Sheets

FIXING APPARATUS

BACKGROUND OF THE INVENTION

1. Field of the Invention

Aspects of the present invention generally relate to a fixing apparatus mounted on an image forming apparatus using an electrophotographic method such as a printer, a copier, or a fax machine for fixing a toner image formed on a recording material onto the recording material.

2. Description of the Related Art

In recent years, fixing apparatuses employing a method called film heating method has been widely used. A fixing apparatus employing the film heating method includes a film, a ceramic heater contacting the inner face of the film, and a pressure roller. The pressure roller is a pressure-applying rotating member which forms a nip portion together with the ceramic heater via the film. At the nip portion, a toner image is fixed onto a recording material by an application of heat while the recording material with the toner image passes through the portion.

The above-described fixing apparatus is advantageous in that if a film with a small heat capacity is used, the time required for the film to reach the fixing temperature (i.e., warm-up time) can be reduced and, further, power consumption can be reduced.

As a pressure roller for the above-described fixing apparatus employing the film heating method, a pressure roller with a so-called reverse crown shape is widely used. The outer diameter of such a pressure roller is the smallest at the center portion and gradually increases toward the end portions in the longitudinal direction.

If this pressure roller is used, when a recording material passes through the nip portion, the recording material is conveyed relatively faster at the end portions in the longitudinal direction compared to the center portion. Accordingly, the occurrence of warp and crease of the recording material at the nip portion can be reduced.

However, even if a pressure roller with the reverse crown shape is used, if the amount of reverse crown is reduced, the effect of preventing the crease of the recording material will be reduced.

For example, since the heat dissipation at the end portions of the pressure roller in the longitudinal direction is greater than the heat dissipation at the center portion of the pressure roller, the temperature at the end portions of the pressure roller in the longitudinal direction may be lower than the temperature at the center portion. In this case, since the thermal expansion at the center portion of the pressure roller in the longitudinal direction will be greater than the end portions of the pressure roller, the amount of reverse crown is reduced compared to when the pressure roller is cooled.

Further, there may be a pressure roller having the reverse crown shape covered with a straight tube outside the rubber layer having the reverse crown shape. The tube serves as a release layer. A pressure roller 22 illustrated in FIG. 9 is a reverse crown shape pressure roller having a rubber layer 27 which also has a reverse crown shape and is covered with a tube 28 as a straight shape release layer.

With this pressure roller, a tension F2 which the rubber layer receives from the tube at the end portions is greater than a tension F1 at the center portion of the pressure roller in the longitudinal direction. Thus, if the whole pressure roller 22 is heated, since the center portion tends to expand more due to thermal expansion of the rubber, the amount of reverse crown of the pressure roller is reduced.

Japanese Patent Application Laid-Open No. 2005-195856 discusses a pressure roller having the amount of reverse crown set with a sufficient margin in a predetermined temperature state so that the predetermined amount of reverse crown can be maintained.

However, when the amount of reverse crown of a pressure roller is set as discussed in Japanese Patent Application Laid-Open No. 2005-195856, if the pressure roller is cooled as is the case when the printing is started, the conveying speed of the recording material at the end portions will be faster compared to the center portion of the pressure roller in the longitudinal direction, and the recording material may be warped. Then, according to this warp, the recording material may be deformed and greatly spring up. Accordingly, the toner image on the recording material contacts, for example, a guide and a defective image may be generated.

SUMMARY OF THE INVENTION

Aspects of the present invention relate to a fixing apparatus capable of preventing occurrence of a paper crease of the recording material regardless of a status of use of a pressure roller by maintaining an appropriate reverse crown shape of the pressure roller.

According to an aspect of the present invention, a fixing apparatus for fixing a toner image on a recording material while conveying the recording material bearing the toner image at a nip portion includes a cylindrical film, a heater configured to contact an inner face of the film and capable of changing a heat distribution in a generatrix direction of the cylindrical film, and a pressure member configured to form the nip portion together with the heater via cylindrical film, the pressure member including a region on which a diameter of the pressure member is increased from a center portion toward an end portion, wherein the fixing apparatus performs heater control so that a ratio of an amount of heat generation at the end portion of the heater to an amount of heat generation at the center portion of the heater is changed based on a temperature of the end portion of the pressure member, during a period at least from when warm-up of the fixing apparatus is started until the recording material reaches the nip portion.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
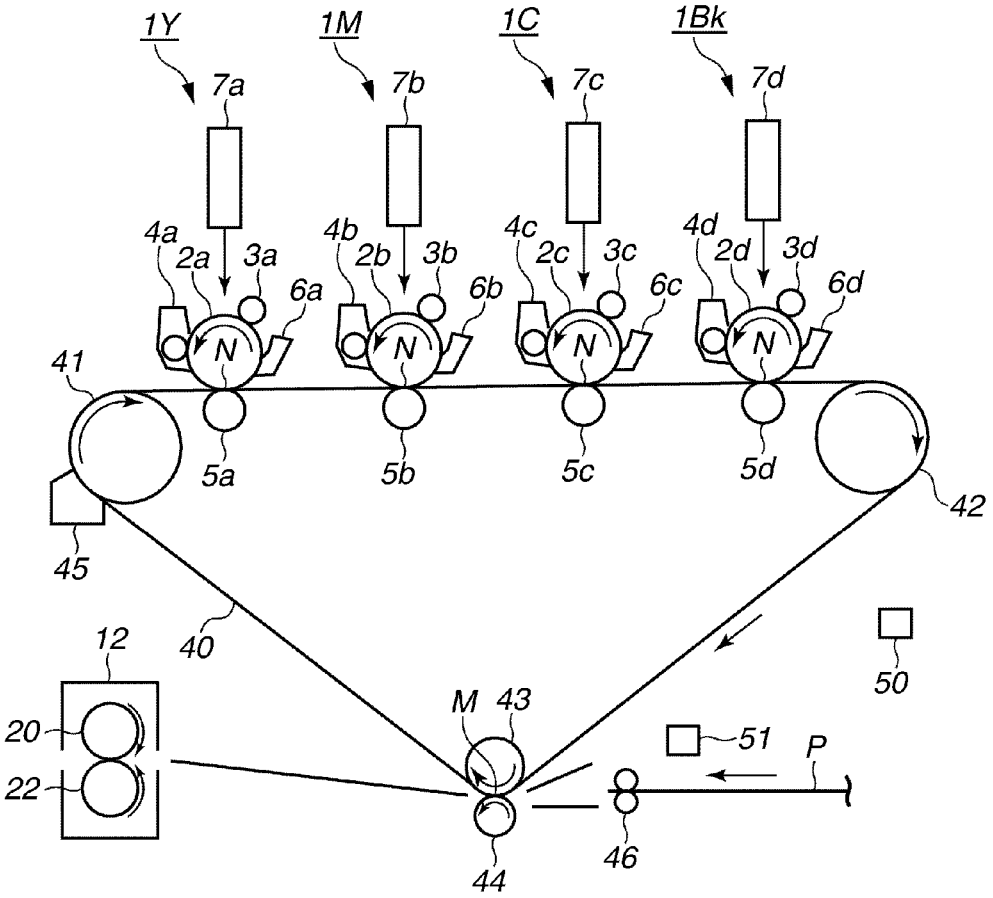
FIG. 1 is a cross sectional view of an image forming apparatus capable of mounting a fixing apparatus according to a first exemplary embodiment.

FIG. 1 illustrates a schematic configuration of a color image forming apparatus mounting a fixing apparatus according to a first exemplary embodiment of the present invention. The image forming apparatus is a tandem type full-color printer employing an electrophotographic method. The image forming apparatus includes four image forming units each of which corresponds to each of four colors. The four image forming units are arranged in a row with a certain interval in between.

The image forming units include an image forming unit 1Y which forms a yellow image, an image forming unit 1M which forms a magenta image, an image forming unit 1C which forms a cyan image, and an image forming unit 1Bk which forms a black image.

In the following description, the image forming unit 1Y which forms a yellow image will be described. Since the configurations of the image forming units of other colors are similar to the configuration of the image forming unit of the yellow color, their descriptions are omitted.

The image forming unit 1Y includes a photosensitive drum 2*a*. In the periphery of the photosensitive drum 2*a*, there are provided a charge roller 3*a*, a development device 4*a*, a transfer roller 5*a*, and a drum cleaning device 6*a*. Further, between and above the charge roller 3*a* and the development device 4*a*, there is provided an exposure device 7*a*. The development device 4*a* contains yellow toner.

An intermediate transfer belt (transfer member) 40, which is an endless belt, contacts each primary transfer portion N of each of the photosensitive drums 2*a*, 2*b*, 2*c*, and 2*d* corresponding to the image forming units 1Y, 1M, 1C, and 1Bk. The intermediate transfer belt 40 is a transfer medium which is stretched around a drive roller 41, a support roller 42, and a secondary transfer counter roller 43, and rotates in the direction of an arrow (clockwise) by the drive of the drive roller 41.

Each of the transfer rollers 5*a*, 5*b*, 5*c*, and 5*d* for the primary transfer contacts each of the photosensitive drums 2*a*, 2*b*, 2*c*, and 2*d* at each of the primary transfer portions N via the intermediate transfer belt 40.

The secondary transfer counter roller 43 contacts a secondary transfer roller 44 via the intermediate transfer belt 40 and forms a secondary transfer portion M. In the vicinity of the drive roller 41 outside the intermediate transfer belt 40, there is provided a belt cleaning device 45 which removes and collects the un-transferred residual toner on the surface of the intermediate transfer belt 40. Further, a fixing apparatus 12 is provided downstream of the secondary transfer portion M in the conveying direction of a recording material P.

When a print signal is output, the photosensitive drums 2*a*, 2*b*, 2*c*, and 2*d*, which rotate at a predetermined process speed, are uniformly charged by the charge rollers 3*a*, 3*b*, 3*c*, and 3*d*, respectively. According to the present exemplary embodiment, the photosensitive drums are negatively charged.

Each of the exposure devices 7*a*, 7*b*, 7*c*, and 7*d* converts a color-separated image signal into a light signal at a laser output unit (not illustrated). Each of the photosensitive drums 2*a*, 2*b*, 2*c*, and 2*d*, which is charged, is scanned by the laser beam as the converted light signal, and an electrostatic latent image is formed.

Then, by the development device 4*a* with a developing bias of the polarity same as the charge polarity (negative polarity) of the photosensitive drum 2*a*, yellow toner is electrostatically attracted to the photosensitive drum 2*a* where the electrostatic latent image is formed according to the charge potential of the surface of the photosensitive member. According to this electrostatic attraction, the electrostatic latent image is visualized.

The yellow toner image is primary transferred onto the rotating intermediate transfer belt 40 at the primary transfer portion N by the transfer roller 5*a*. A primary transfer bias, which is a reverse polarity of the polarity of the toner (positive polarity), is applied to the transfer roller 5*a*.

The intermediate transfer belt 40, onto which the yellow toner image is transferred, rotates toward the image forming unit 1M. Similarly, a magenta toner image formed on the photosensitive drum 2*b* of the image forming unit 1M is superimposed on the yellow toner image on the intermediate transfer belt 40, and transferred at the primary transfer portion N.

Similarly, cyan and black toner images formed on the photosensitive drums 2*c* and 2*d* of the image forming units 1C and 1Bk are sequentially superimposed on the yellow and magenta toner images on the intermediate transfer belt 40, and transferred at each primary transfer portion N.

In this manner, a full-color toner image is formed on the intermediate transfer belt 40. Then, at a timing when the leading edge of the full-color toner image on the intermediate transfer belt 40 is conveyed to the secondary transfer portion M, the recording material (transfer material) P is conveyed to the secondary transfer portion M by a registration roller 46.

Subsequently, the full-color toner image is transferred at once on the recording material P by the secondary transfer roller 44. A secondary transfer bias (reverse polarity of the toner (positive polarity)) is applied to the transfer roller 44.

The recording material P with the full-color toner image is conveyed to a fixing unit 12. Then, heat and pressure is applied to the full-color toner image at a nip portion formed between a film 20 and the pressure roller 22. Accordingly, the full-color toner image is fixed to the surface of the recording material P.

The recording material P is discharged and output as an output image from the image forming apparatus. Then, the image forming operation ends.

When the above-described primary transfer is performed, residual toner on the photosensitive drums 2*a*, 2*b*, 2*c*, and 2*d* after the primary transfer is removed and collected by the drum cleaning devices 6*a*, 6*b*, 6*c*, and 6*d*. Further, residual toner that remains on the intermediate transfer belt 40 after the secondary transfer is removed and collected by the belt cleaning device 45.

Figure 2:
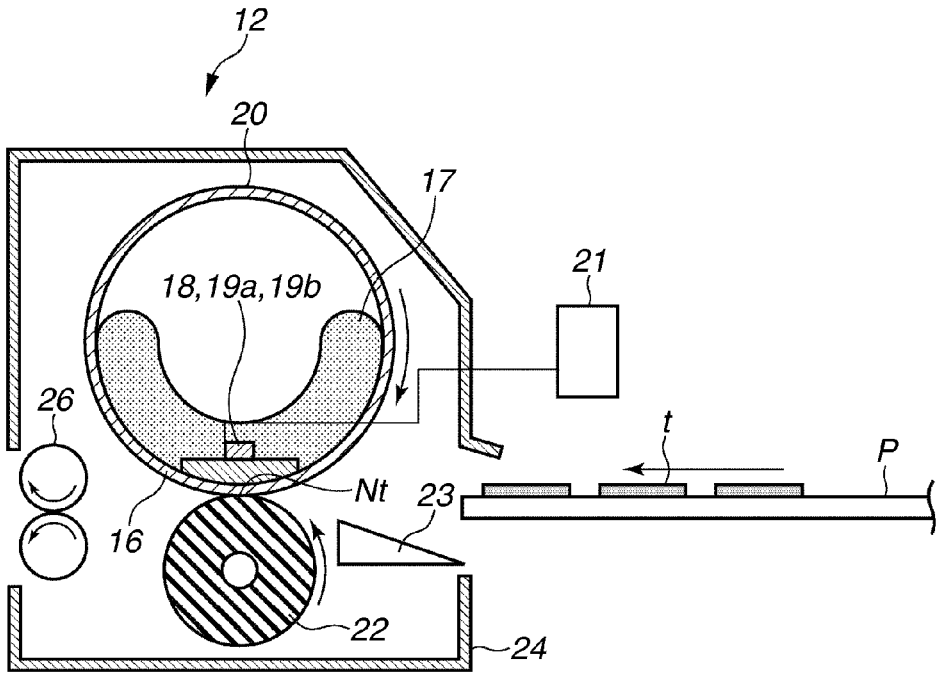
FIG. 2 is a cross sectional view of the fixing apparatus according to the first exemplary embodiment.
Figure 3:
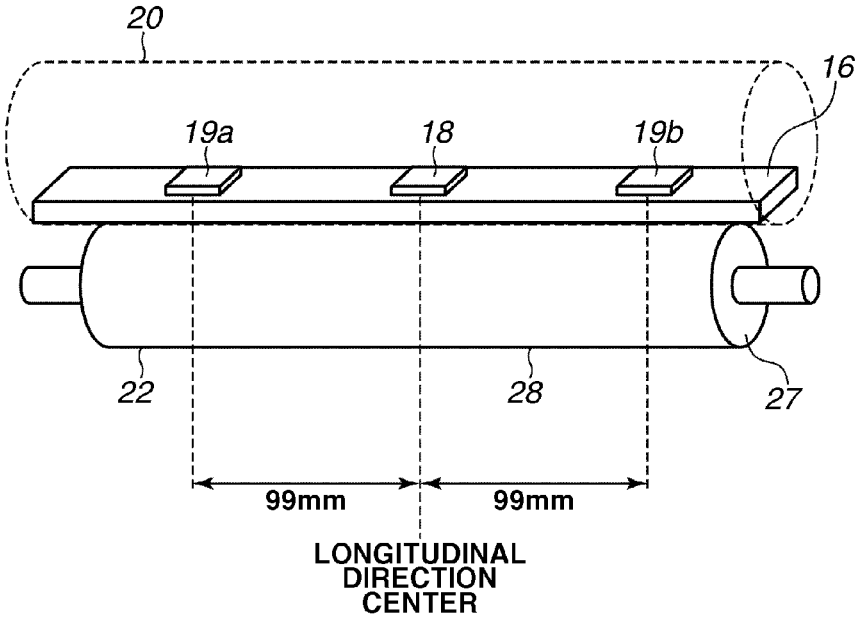
FIG. 3 is a perspective view of the fixing apparatus according to the first exemplary embodiment.

Next, the fixing apparatus 12 according to the present exemplary embodiment will be described with reference to FIGS. 2 and 3. The fixing apparatus 12 is a film heating-type device. FIG. 2 is a schematic diagram of the fixing apparatus 12. FIG. 3 is a perspective view of the fixing apparatus 12.

The fixing apparatus 12 includes the film 20, a heater 16, and the pressure roller 22. The film 20 is a rotatable heating member provided in a rolled manner. The heater 16 contacts the inner face of the film 20. The pressure roller 22 is a rotating member for pressure application and forms a nip portion Nt together with the heater 16 via the film 20. When the recording material carrying the toner image passes through the nip portion Nt, heat is applied to the recording material. Accordingly, the toner image is fixed onto the recording material.

According to the present exemplary embodiment, the heater 16 is a ceramic heater. Details of the heater 16 will be described below.

The pressure roller 22 is a stainless metal core having a layer of silicone rubber formed on the outer periphery of the metal core by injection molding. The silicone rubber layer is further coated by tetrafluoroethylene-perfluoroalkyl vinyl ether copolymer (PFA) resin. The end portions of the metal core of the pressure roller 22 are rotatably supported by side plates (not illustrated) at the rear side and the front side of an apparatus frame 24. Details of the pressure roller 22 will be described below.

A heater holder 17 is a trough-shape member having heat resistance and rigidity. Its cross section is approximately semi-circular. The heater 16 is provided along the longitudinal direction of the heater holder 17.

Further, the film 20 covers the heater holder 17 so that the heater holder 17 loosely fits in the film 20. The inner face of the film 20 is guided by the heater holder 17. The heater holder 17 is formed using liquid crystal polymer resin with high heat resistance.

The heater 16, the heater holder 17, and the film 20 are integrated into a unit in the fixing apparatus 12. Hereinafter, this unit will be referred to as a film unit.

The film unit presses the pressure roller 22 via the film 20 in the direction perpendicular to the axial direction of the pressure roller 22 by the heater 16 pressed by a force of 12.5 kgf for each side of the heater holder 17 by a pressure mechanism (not illustrated) in the facing direction of the pressure roller. According to this pressure mechanism, the nip portion Nt having a predetermined width necessary for the fixing processing is formed.

A main thermistor 18 is a thermistor as a first temperature detection member. Sub-thermistors 19*a* and 19*b* are thermistors as second temperature detection members. The main thermistor 18 and the sub-thermistors 19*a* and 19*b* contact the heater 16 at the side opposite the facing side of the heater 16 with the pressure roller 22. The side which the thermistors contact the heater 16 is hereinafter referred to as the back side.

The main thermistor 18 is provided at the center portion of the heater 16 in the longitudinal direction or in the vicinity of the center portion. The sub-thermistors 19*a* and 19*b* are provided at a same distance away from the center of the heater 16 in the longitudinal direction. To be more precise, each of the sub-thermistors is provided 99 mm away from the center of the heater. The main thermistor 18 and the sub-thermistors 19*a* and 19*b* are connected to a control unit 21 illustrated in FIG. 2. The control unit 21 controls the heater 16 based on the temperatures detected by the main thermistor 18 and the sub-thermistors 19*a* and 19*b*.

An entrance guide 23 and a discharge roller 26 are also provided in the vicinity of the film unit. The entrance guide 23 guides the recording material P so that it is accurately conveyed to the nip portion Nt of the fixing apparatus 12. In the present exemplary embodiment, the entrance guide 23 is formed by polyphenylene sulfide (PPS) resin.

The pressure roller 22 rotates counterclockwise in the direction indicated by the arrow at a predetermined circumferential velocity by a drive of an actuator (not illustrated). Due to the rotation of the pressure roller 22, a frictional force occurs at the nip portion Nt. According to this frictional force, a rotary force acts on the film 20.

The film 20 rotates clockwise in the direction indicated by the arrow at the outer periphery of the heater holder 17. When the film 20 rotates, the inner face of the film and the heater 16 rub against each other. In order to reduce the frictional resistance between the inner face of the film 20 and the heater 16 or the heater holder 17, grease is applied to the inner face of the film 20.

The heater 16 is energized when the pressure roller 22 rotates and the film 20 is driven according to the rotation of the pressure roller 22. In a state where after the heater 16 reaches the target temperature for the fixing processing and controlled to keep the target temperature, the recording material P carrying an unfixed toner image is conveyed to the nip portion Nt. At the nip portion Nt, the image-bearing side of the recording material P fully contacts the outer side of the film 20, and the recording material P is conveyed together with the film 20.

During this conveying process, the heat of the heater 16 is applied to the recording material P via the film 20, and the unfixed toner image on the recording material P is fixed onto the recording material P. Then, the recording material P which passed through the nip portion Nt is separated from the film 20 and discharged from the apparatus by the discharge roller 26.

Next, the configuration of the heater 16 according to the present exemplary embodiment will be described with reference to FIG. 4. A substrate 100 has high thermal conductance and is made of a ceramic material such as alumina or aluminum nitride. The substrate 100 has an elongated shape and its width in the widthwise direction is wider than the width of the nip portion Nt in the recording material conveying direction.

The heater 16 is a back side heating type heater. In other words, heat generating resistors are formed on the back side of the face of the substrate 100 that faces the pressure roller 22 by, for example, screen printing, in the longitudinal direction of the substrate 100. The heat generating resistors are made of a conductive material such as silver-palladium (Ag/Pd), and include at least a first heat generating resistor 101 and a second heat generating resistor 102. An insulation protection layer 106 made of glass is formed on the first heat generating resistor 101 and the second heat generating resistor 102.

Figure 4:
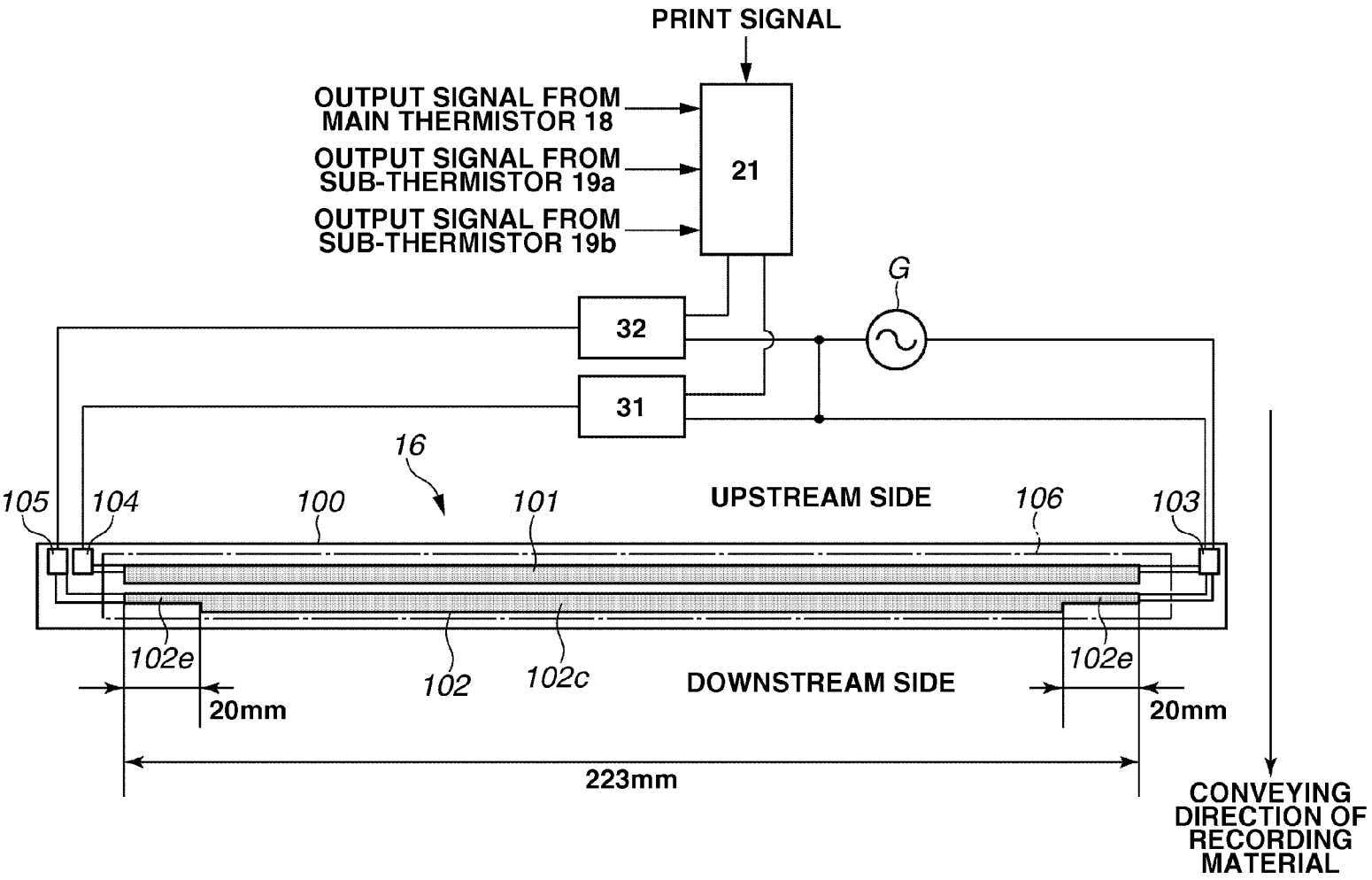
FIG. 4 illustrates a configuration of a heater according to the first exemplary embodiment.

As illustrated in FIG. 4, the length of each of the first heat generating resistor 101 and the second heat generating resistor 102 formed on the substrate 100 is 223 mm in the longitudinal direction of the substrate 100.

The first heat generating resistor 101 generates heat when power is fed between an electrode member 103 and an electrode member 104 from a commercial power source G via a first triac 31. The second heat generating resistor 102 generates heat when power is fed between the electrode member 103 and an electrode member 105 from the commercial power source G via a second triac 31.

The control unit 21 controls the heater 16 so that the temperature of the heater 16 detected by the main thermistor 18 illustrated in FIG. 3 is maintained at the target temperature. The control unit 21 controls the heater by appropriately controlling a duty ratio and/or the wave number of the voltages applied to the first heat generating resistor 101 and the second heat generating resistor 102.

Further, the power can be independently supplied to the first heat generating resistor 101 and the second heat generating resistor 102. The second heat generating resistor 102 provided on the substrate 100 and arranged on the downstream side in the recording material conveying direction is formed so that the resistance per unit length is higher at the end portions of the substrate 100 in the longitudinal direction than the resistance at the center portion.

More specifically, as illustrated in FIG. 4, at regions 20 mm from the ends of the substrate 100 having the length of 223 mm in the longitudinal direction, by reducing the length in the crosswise direction of the second heat generating resistor 102, the resistance per unit length of only that regions of the second heat generating resistor 102 at the end portions will be higher compared to the center portion.

If the resistance value per unit length of the second heat generating resistor 102 at the center portion in the longitudinal direction is 100%, the resistance value is 120% per unit length at the end portions in the longitudinal direction. Thus, the amount of heat generation at the end portions of the second heat generating resistor 102 in the longitudinal direction of the substrate 100 is greater compared to the amount of heat generation at the center portion. The resistance value per unit length of the first heat generating resistor 101 is uniform in the longitudinal direction of the substrate 100.

Further, according to the present exemplary embodiment, the resistance values of the first heat generating resistor 101 and the second heat generating resistor 102 in the longitudinal direction of the substrate 100 are substantially the same. In other words, the resistance value between the electrode members 103 and 104 of the first heat generating resistor 101 and the resistance value between the electrode members 103 and 105 of the second heat generating resistor 102 are equal.

As a result, if power is supplied to the first heat generating resistor 101 and the second heat generating resistor 102 at the same duty ratio, the amount of heat generation of the whole first heat generating resistor 101 in the longitudinal direction will be equal to the amount of heat generation of the whole second heat generating resistor 102 in the longitudinal direction. However, since the amount of heat generation at the end portions of the second heat generating resistor 102 in the longitudinal direction of the substrate 100 is greater than the amount of heat generation at the center portion, the heat distribution of the heater 16 in the longitudinal direction is greater at the end portions compared to the center portion.

Thus, by changing the duty ratio of the first heat generating resistor 101 and the duty ratio of the second heat generating resistor 102, the heat distribution of the heater 16 in the longitudinal direction can be changed.

Next, the pressure roller 22 according to the present exemplary embodiment will be described in detail. The pressure roller 22 is a pressure member having the rubber layer 27 covering the outer peripheral surface of a metal core made of metal such as steel use stainless (SUS). The rubber layer 27 is made of heat-resistant rubber such as silicone rubber and is approximately 3.5 mm thick. A ratio of a diameter of pressure roller 22 at an end portion to a diameter of pressure roller 22 at a center portion can be changed by changing the duty ratio of the first heat generating resistor 101 and the duty ratio of the second heat generating resistor 102.

Further, a release layer 28 made of tetrafluoroethylene-perfluoroalkyl vinyl ether copolymer (PFA) and of a thickness of 70 μm is formed on the rubber layer 27. The length of the rubber layer and the release layer of the pressure roller 22 in the longitudinal direction is 231 mm. Further, both the lengths from the center in the longitudinal direction to the right and the left ends are 115.5 mm.

Figure 5:
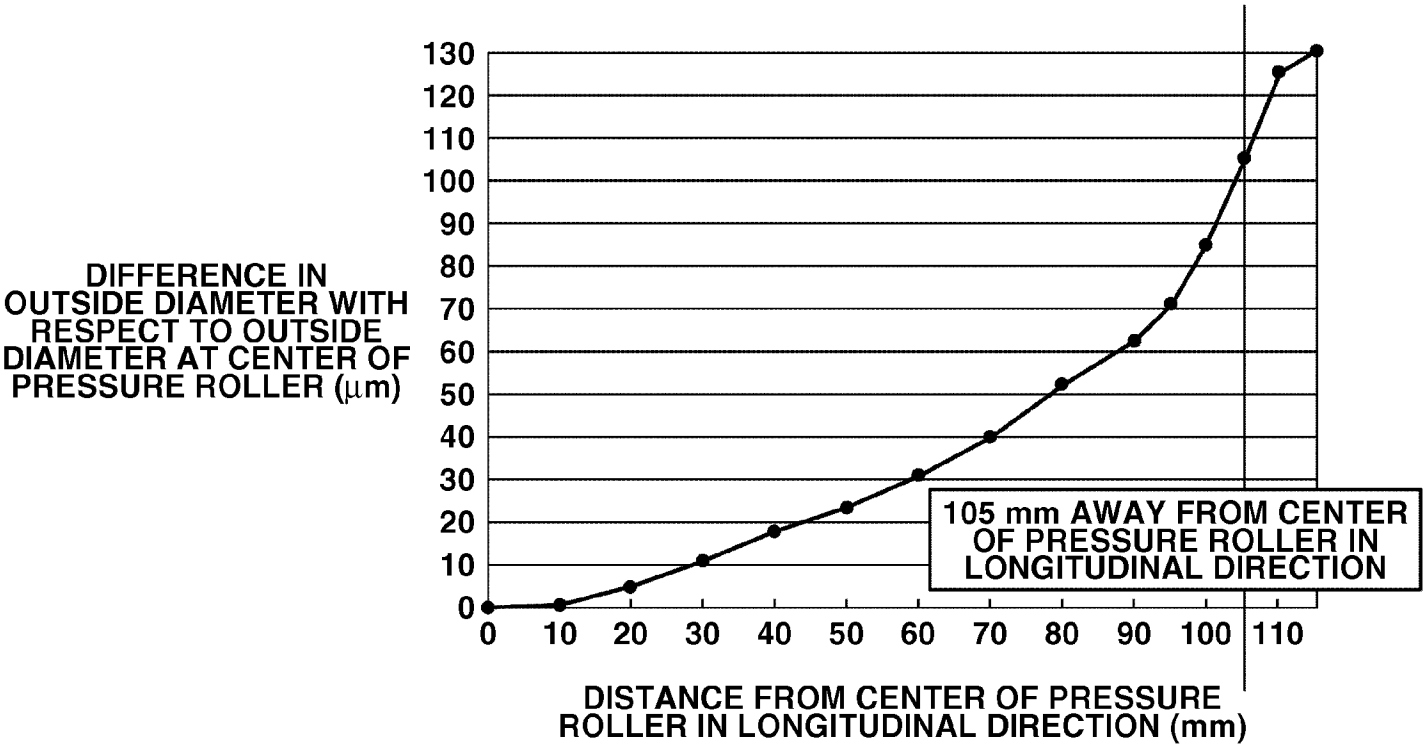
FIG. 5 is a graph illustrating an outside diameter of a pressure roller of the fixing apparatus in the longitudinal direction according to the first exemplary embodiment.

Next, the amount of reverse crown of the pressure roller 22 according to the present exemplary embodiment will be described. The graph in FIG. 5 illustrates the outside diameter of the pressure roller 22 in the longitudinal direction in the ambient temperature of 25 degrees C. according to the present exemplary embodiment. The vertical axis of the graph in FIG. 5 represents the difference of the outside diameter of the pressure roller 22 with respect to the outside diameter (25 mm) at the center of the pressure roller in the longitudinal direction.

Further, the shape of the pressure roller is symmetric with respect to the center of the pressure roller in the longitudinal direction. Thus, FIG. 5 is a partial illustration of the pressure roller 22 from the center to one end of the pressure roller in the longitudinal direction. From FIG. 5, it is understood that the pressure roller 22 has a reverse crown shape with the outside diameter gradually increasing from the center toward the end of the pressure roller.

Figure 6:
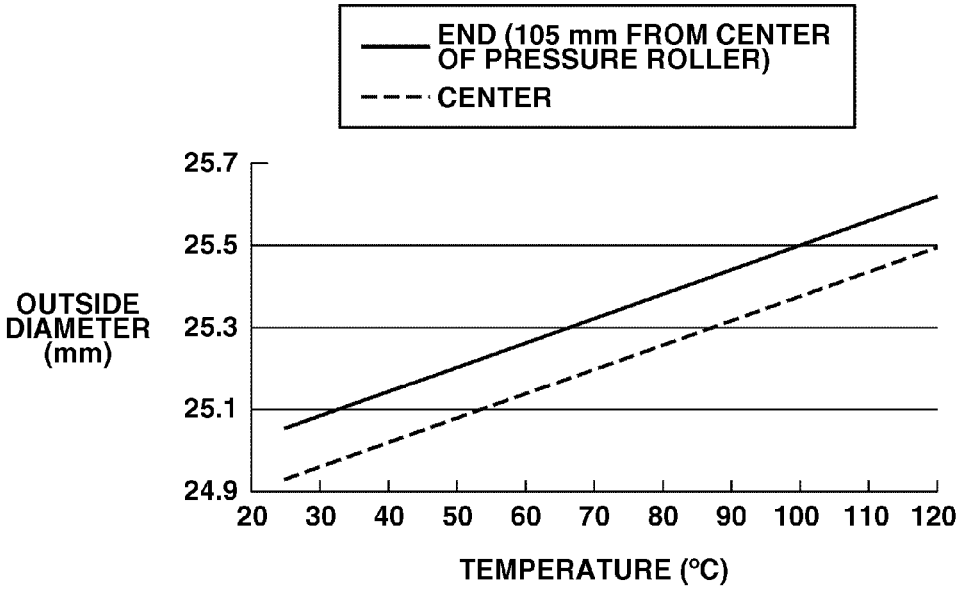
FIG. 6 is a graph illustrating thermal expansion of the pressure roller of the fixing apparatus according to the first exemplary embodiment.

FIG. 6 illustrates a measurement result of the outside diameter of the pressure roller 22 when the pressure roller 22 is heated. The measurement positions are the center of the pressure roller in the longitudinal direction (i.e., first point) and 105 mm away from the center of the pressure roller in the longitudinal direction to the end of the pressure roller (i.e., second point). The second point corresponds to a position 3 mm away from the end of a LTR size recording material in the widthwise direction.

Referring to FIG. 6, it is understood the outside diameter at the center as well as the outside diameters at the end portions of the pressure roller in the longitudinal direction linearly increase as the temperature rises. This is due to the thermal expansion of the rubber layer. The reason for the difference between the outside diameter of the center portion in the longitudinal direction and the outside diameters of the end portions of the pressure roller 22 at the ambient temperature (25 degrees C.) is because the outside diameter of the center portion is smaller than the outside diameters of the end portions due to the reverse crown shape.

From this measurement result, it is understood that the thermal expansion of both the center portion and the end portions of the pressure roller in the longitudinal direction is 6 μm/degrees C.

According to the present exemplary embodiment, a case where a recording material passes through the nip portion Nt of the fixing apparatus when the fixing apparatus is in a warm state will be considered. The state where the fixing apparatus is sufficiently warm is achieved immediately after 100 sheets of LTR size recording materials are continuously passed.

If the fixing apparatus is sufficiently cooled, there is little difference between the temperatures detected by the main thermistor 18 and by the sub-thermistors 19*a* and 19*b*.

On the other hand, the above-described temperature difference when the fixing apparatus 12 is sufficiently warm changes due to the history of the previous print job and the standby time of the fixing apparatus 12 after the previous print job has been completed.

Next, the change in the temperature difference will be described. The temperatures of the heater 16 detected by the main thermistor 18, the sub-thermistor 19*a*, and the sub-thermistor 19*b* are referred to as temperatures Tm, Ts1, and, Ts2, respectively. In the following description, a temperature difference obtained by subtracting the temperature detected by the sub-thermistor 19*a* from the temperature detected by the main thermistor 18 (Tm-Ts1) is expressed as ΔT1, and a temperature difference obtained by subtracting the temperature detected by the sub-thermistor 19*b* from the temperature detected by the main thermistor 18 (Tm-Ts2) is expressed as ΔT2.

Since the temperature at the center portion becomes higher than the temperatures at the end portions of the heater 16 in the longitudinal direction when the temperature differences ΔT1 and ΔT2 increase, the center portion in the longitudinal direction of the pressure roller 22 tends to expand due to heat compared to the end portions. If the center portion of the pressure roller 22 expands, the amount of reverse crown will be reduced. Accordingly, the possibility of occurrence of the crease of recording material will be increased.

Figure 7:
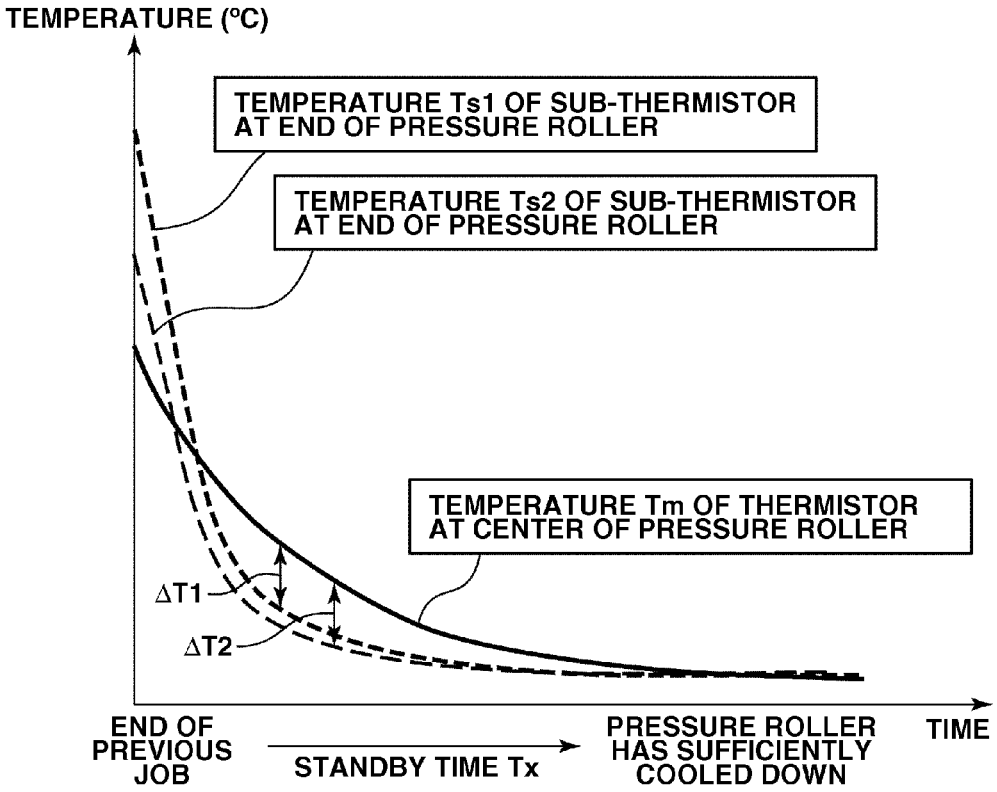
FIG. 7 is a graph illustrating transition of temperature detected by a temperature detecting element of the fixing apparatus according to the first exemplary embodiment.

FIG. 7 illustrates transitions of the temperatures Tm, Ts1, and, Ts2 after the printing is completed. The temperatures Tm, Ts1, and, Ts2 immediately after the printing has been completed change greatly depending on the content of the print job which has been performed.

For example, since the temperatures of non-sheet-passing portions of the recording material rise greatly immediately after a great number of recording materials of a small size are continuously printed, the temperatures Ts1 and Ts2 detected by the sub-thermistors tend to increase. When the printing is completed, the temperatures Tm, Ts1, and Ts2 gradually decrease due to heat dissipation.

Since the amount of heat dissipation of the pressure roller 22, the film 20, and the heater 16 at the end portions of the pressure roller 22 is greater than the heat dissipation at the center portion, the temperature differences ΔT1 and ΔT2 gradually increase for a while after printing. However, when the temperature of the fixing apparatus reaches the ambient temperature (25 degrees C.), the temperature differences ΔT1 and ΔT2 will be approximately zero.

As described above, the temperature differences ΔT1 and ΔT2 change according to the history of the previous print job and standby time Tx after printing. According to the changes of the temperature differences ΔT1 and ΔT2, the amount of reverse crown of the pressure roller also changes. In the following description, the temperature difference with a larger value out of the temperature differences ΔT1 and ΔT2 will be set as a temperature difference ΔT.

Table 1 illustrates the power distribution ratio of a second heat generating resistor 1021 with respect to the first heat generating resistor 101 of the heater 16 according to the temperature difference ΔT in the period until the recording material enters the nip portion Nt.

TABLE 1

Setting of power distribution ratio according to temperature difference ΔT

| | Temperature Difference ΔT | | | |
|---|---|---|---|---|
| | <0 deg | 0-10 deg | 10-20 deg | 20 deg ≤ |
| Power distribution ratio | 100% | 110% | 120% | 130% |

According to the present exemplary embodiment, maximum power which can be supplied to the heater 16 (1000 W) is supplied to the heater most of the time from when the operation of the fixing apparatus 12 is started until the recording material enters the nip portion Nt. In Table 1, if the power distribution ratio of the second heat generating resistor 102 with respect to the first heat generating resistor 101 is 100%, it means that a same power (500 W) is supplied to the first heat generating resistor 101 and the second heat generating resistor 102.

Further, if the power distribution ratio of the second heat generating resistor 102 with respect to the first heat generating resistor 101 is 120%, the power supplied to the first heat generating resistor 101 is 455 W and the power supplied to second heat generating resistor is 545 W.

The heater 16 is controlled so that the power distribution ratio in the table 1 is realized without the total power supplied to the first heat generating resistor 101 and the second heat generating resistor 102 exceeding 1000 W.

Table 1 illustrates a case where a LTR-size recording material with a width of 216 mm is conveyed by the fixing apparatus 12 according to the present exemplary embodiment. The width 216 mm is the maximum width which can be conveyed by the fixing apparatus. According to the present exemplary embodiment, the recording material passes through the nip portion Nt of the fixing apparatus 12 at a speed of 240 mm/sec and the throughput is 40 sheets/minute.

Figure 11:
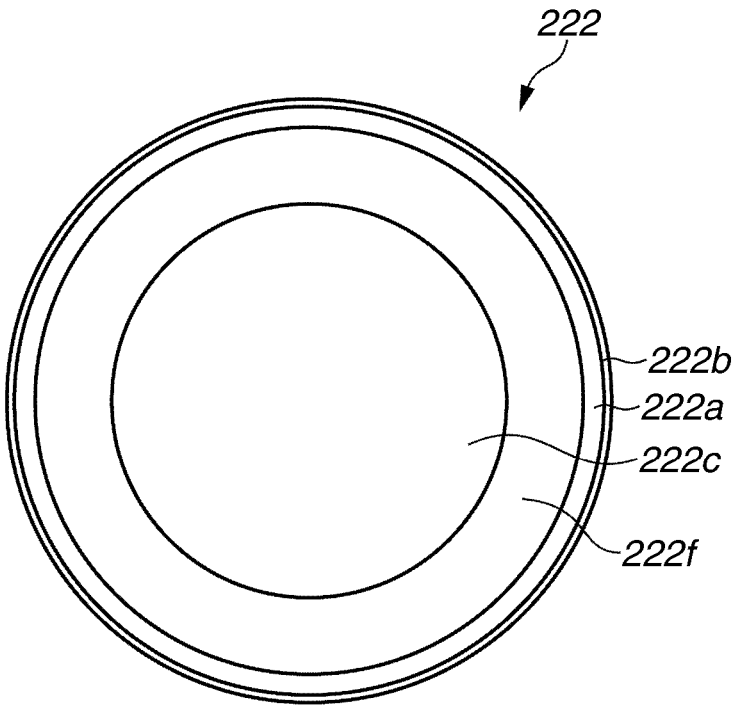
FIG. 11 is a cross sectional view of the pressure roller according to the first and the second exemplary embodiments.

The distinctive point of the present exemplary embodiment is that, as illustrated in FIG. 11, if the temperature difference ΔT when a print signal is received is greater than a predetermined value, the power distribution ratio of the second heat generating resistor with respect to the first heat generating resistor of the heater 16 is increased until just before the recording material enters the nip portion Nt compared to a case where the temperature difference ΔT is small.

This is to maintain the appropriate amount of reverse crown by increasing the amount of heat generation at the end portions of the heater 16 in the longitudinal direction and thermally expanding the ends of the pressure roller 22 since the amount of reverse crown of the pressure roller 22 decreases when the temperature difference ΔT increases.

As a result, regardless of the history of the previous print job and the standby time after the completion of the print job, the amount of reverse crown of the pressure roller 22 is maintained at an appropriate amount. Thus, even if the fixing apparatus starts printing in a warm state, the occurrence of paper crease can be prevented.

By starting the heater control (i.e., increasing the power distribution ratio of the second heat generating resistor with respect to the first heat generating resistor) at the timing the warm-up of the fixing apparatus is started, that is, the timing the heater 16 is energized, maximum time can be secured for setting the amount of reverse crown of the pressure roller 22 to the appropriate amount.

However, the timing the above-described heater control is started can be set to any timing in the period from when the heater 16 is energized until the recording material enters the nip portion Nt.

Next, a modification example 1 of the first exemplary embodiment will be described. If the pressure roller 22 has been used for a long time, the amount of reverse crown of the pressure roller 22 may be reduced due to durability reasons.

In such a case, as illustrated in Table 2, if the temperature difference ΔT is greater than a predetermined value, in addition to setting the power distribution ratio of the second heat generating resistor with respect to the first heat generating resistor of the heater 16 to a higher value compared to a case where the temperature difference ΔT is smaller, the power distribution ratio may be changed according to the cumulative number of sheets which have been printed using the pressure roller 22.

TABLE 2

Setting of Power distribution ratio according to Temperature Difference ΔT and Cumulative Number of Sheets

| Cumulative Number of Sheets | Temperature Difference ΔT | | | |
|---|---|---|---|---|
| | <0 | 0-10 deg | 10-20 deg | 20 deg ≤ |
| 0-50000 | 100% | 110% | 120% | 130% |
| 50001-100000 | 110% | 120% | 130% | 140% |
| 100001-150000 | 120% | 130% | 140% | 150% |
| 150001-200000 | 130% | 140% | 150% | 160% |
| 200001- | 140% | 150% | 160% | 170% |

More specifically, even if the temperature difference ΔT is not changed, if the cumulative number of sheets printed using the pressure roller 22 is greater than a predetermined number, the power distribution ratio of the second heat generating resistor with respect to the first heat generating resistor of the heater 16 is set to a higher value compared to a case where the cumulative number of sheets is smaller than the predetermined number.

Next, a modification example 2 of the first exemplary embodiment will be described. It is known that the amount of reverse crown of the pressure roller 22 is tends to reduce more when the pressure roller 22 has been used for a long period of time in a high temperature state.

The pressure roller 22 is used in a high temperature state when, for example, a small size recording material with a narrow width is conveyed. If the maximum width of the recording material which can be conveyed by the fixing apparatus 12 is the width of a LTR size (216 mm) sheet, the small size recording material with a smaller width corresponds to a recording material such as a A4, B5, or A5 size sheet.

If a small size recording material is conveyed, the temperature of the non-sheet-passing portion rises since the length of the heat generating resistor in the longitudinal direction on the heater 16 is longer with respect to the width of the recording material in a direction perpendicular to the conveying direction of the recording material. Further, since the width of the recording material is small with respect to the length of the pressure roller 22 in the longitudinal direction, the heat of the heater 16 is directly applied to the pressure roller 22 via the film 20. Thus, the temperature at the end portions of the pressure roller 22 in the longitudinal direction will be increased.

Further, even if recording materials of a same width are conveyed, depending on the thickness (grammage) of the recording material, the rise in the temperatures at the end portions of the pressure roller 22 will be changed. According to the modification example 2, the amount of heat applied to the pressure roller 22 is predicted, and the power distribution ratio of the second heat generating resistor with respect to the first heat generating resistor of the heater 16 is set based on the predicted amount of heat.

More specifically, according to the modification example 2, if the maximum value of the temperatures Ts1 and Ts2 detected by the sub-thermistors 19*a* and 19*b* is Tsmax when one recording material passes through the nip portion Nt, Th which can be obtained by Th=Tsmax/100 is added each time a recording material is conveyed to the nip portion.

This cumulative value is referred to as a thermal history cumulative count. In other words, if 100 sheets of a LTR size recording material are continuously printed, since Th=220/100=2.2, 220 (2.2×100=220) will be added as the thermal history cumulative count.

In the above-described case, if the temperature difference ΔT is greater than a predetermined value as illustrated in table 3, in addition to setting a higher power distribution ratio of the second heat generating resistor with respect to the first heat generating resistor of the heater 16 compared to a case where the temperature difference ΔT is smaller than the predetermined value, the power distribution ratio can be changed according to the thermal history cumulative count. More specifically, even if the temperature difference ΔT is not changed, if the thermal history cumulative count is greater than a predetermined number, the power distribution ratio of the second heat generating resistor with respect to the first heat generating resistor of the heater 16 can be set to a higher value compared to a case where the thermal history cumulative count is smaller the predetermined number.

TABLE 3

Setting of Power Distribution Ratio according to Temperature Difference ΔT and Thermal history cumulative count

| Cumulative | Temperature Difference ΔT | | | |
|---|---|---|---|---|
| Count | <0 deg | 0-10 deg | 10-20 deg | 20 deg ≤ |
| 0-110000 | 100% | 110% | 120% | 130% |
| 110001-220000 | 110% | 120% | 130% | 140% |
| 220001-330000 | 120% | 130% | 140% | 150% |
| 330001-440000 | 130% | 140% | 150% | 160% |
| 440001- | 140% | 150% | 160% | 170% |

As described above, according to the modification examples 1 and 2, the occurrence of paper crease can be prevented even if the recording material is conveyed when the fixing apparatus 12 is in a warm state regardless of the durability or thermal history of the fixing apparatus 12.

According to a second exemplary embodiment of the present invention, the power distribution ratio of the second heat generating resistor 102 with respect to the first heat generating resistor 101 of the heater 16 until the recording material is conveyed to the nip portion Nt is set based on the temperature of the pressure roller 22. Descriptions of the components similar to those of the first exemplary embodiment are not repeated.

Figure 9:
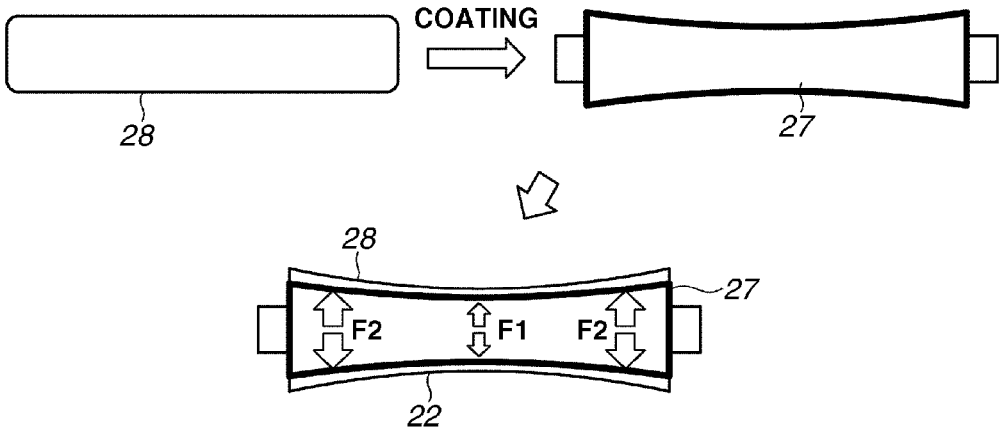
FIG. 9 illustrates a configuration of the pressure roller of the fixing apparatus according to a second exemplary embodiment.
Figure 10:
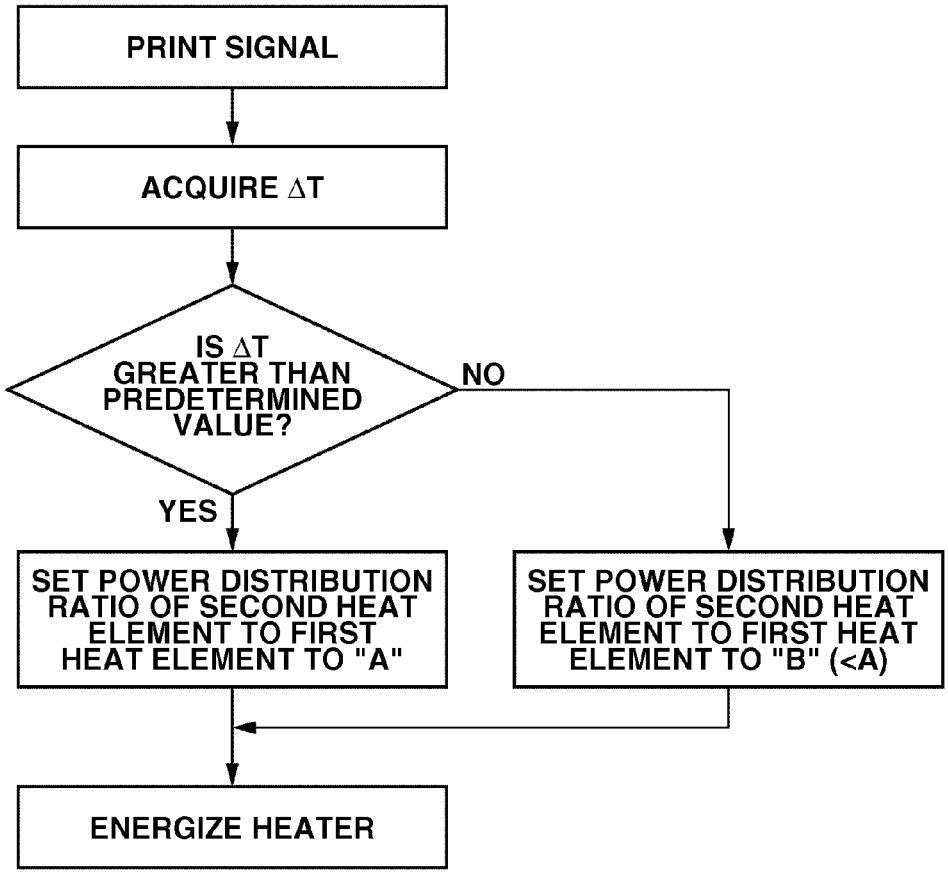
FIG. 10 is a flowchart illustrating a control flow of the heater according to the first exemplary embodiment.

FIG. 9 illustrates a layer configuration of the pressure roller 22 according to the second exemplary embodiment. The pressure roller 22 has the rubber layer 27 having the reverse crown shape. The rubber layer 27 is covered by the tube 28 having a straight shape. The inner diameter of the tube 28 is constant in the generatrix direction of the film 20.

Thus, with respect to the tension (tightening force) applied to the outside of the pressure roller 22 by the above-described tube 28, the tension F2 at the end portions is greater than the tension F1 at the center portion in the longitudinal direction.

Thus, the end portions of the pressure roller 22 in the longitudinal direction are difficult to expand since the end portions need to expand against a tension greater than the tension at the center portion. As a result, the more the entire pressure roller 22 is heated, the more the amount of reverse of crown of the pressure roller 22 is reduced.

This tends to occur especially when intermittent printing where forward rotation and backward rotation are frequently repeated is performed.

Thus, according to the present exemplary embodiment, the temperature of the pressure roller 22 is predicted. Then, according to the predicted temperature, the power distribution ratio of the second heat generating resistor 102 with respect to the first heat generating resistor of the heater 16 is changed in the period from when the print signal is received until the recording material is conveyed to the nip portion Nt.

As a prediction method of the temperature of the pressure roller 22, the print operation is divided into operations such as "during forward rotation (or during backward rotation)", "during fixing processing", and "during standby". Then, the prediction is performed by using a cumulative value calculated by adding or subtracting a coefficient set for each operation for each unit time.

The addition of coefficient means that the temperature of the pressure roller 22 has increased due to heat accumulated in the pressure roller 22 by the heater 16, for example, at the time of forward rotation. The subtraction of coefficient means that the temperature of the pressure roller 22 has decreased due to heat dissipation at standby or heat conducted to the recording material during the fixing processing. Each coefficient is determined according to the amount of change of the temperature of the pressure roller 22 by experiment.

According to the present exemplary embodiment, the saturation temperature of the pressure roller 22 when continuous printing is performed is 90 degrees C. The temperature of the pressure roller 22 rises to 90 degrees C. or more when forward rotation and backward rotation are frequently repeated in the intermittent printing. Further, the temperature of the pressure roller 22 tends to increase when the standby time during print jobs is short.

The method for predicting the temperature of the pressure roller 22 is not limited to the above-described example. Further, instead of predicting the temperature of the pressure roller 22, the temperature can be directly measured by a temperature detection member.

Table 4 illustrates the setting of the power distribution ratio of the second heat generating resistor with respect to the first heat generating resistor corresponding to the predicted temperature of the pressure roller 22.

TABLE 4

| Setting of Power distribution ratio according to Expected Temperature of Pressure Roller | | | |
|---|---|---|---|
| | Pressure Roller Predicted Temperature (deg) | | |
| | <90 deg | 90-120 deg | 120 deg ≤ |
| Power distribution ratio | 100% | 110% | 120% |

According to the present exemplary embodiment, if the predicted temperature of the pressure roller 22 is higher than a predetermined temperature, compared to a case where the predicted temperature is lower than the predetermined temperature, the power distribution ratio of the second heat generating resistor with respect to the first heat generating resistor is increased until the recording material is conveyed to the nip portion Nt.

This is because if the predicted temperature of the pressure roller 22 is higher than a predetermined temperature, it can be assumed that the amount of reverse crown of the pressure roller 22 is reduced compared to a case where the temperature is lower than the predetermined temperature. Thus, the end portions of the pressure roller 22 are expanded by increasing the power distribution ratio of the second heat generating resistor with respect to the first heat generating resistor. In this manner, the appropriate amount of reverse crown can be maintained.

According to the second exemplary embodiment, even if the intermittent printing is repeated a number of times, the occurrence of paper crease can be prevented.

Further, as illustrated in tables 5 and 6, the power distribution ratio can be set by a combination of changing the power distribution ratio according to the temperature of the pressure roller according to the second exemplary embodiment and changing the power distribution ratio according to the durability count of the pressure roller 22, thermal history cumulative count, and the temperature difference ΔT according to the first exemplary embodiment.

TABLE 5

| Setting of Power distribution ratio according to Temperature Difference ΔT and Thermal History Cumulative Count | | | | | | | | | |
|---|---|---|---|---|---|---|---|---|---|
| | Pressure Roller Predicted Temperature (deg) | | | | | | | | |
| | <90 deg Temperature Difference ΔT | | | 90-120 deg Temperature Difference ΔT | | | 120 deg≤ Temperature Difference ΔT | | |
| Cumulative Number of Sheets | <0 deg | 0-20 deg | 20 deg ≤ | <0 deg | 0-20 deg | 20 deg ≤ | <0 deg | 0-20 deg | 20 deg ≤ |
| 0-50000 | 100% | 115% | 130% | 110% | 125% | 140% | 120% | 135% | 150% |
| 50001-100000 | 110% | 125% | 140% | 120% | 135% | 150% | 130% | 145% | 160% |
| 100001-150000 | 120% | 135% | 150% | 130% | 145% | 160% | 140% | 155% | 170% |
| 150001-200000 | 130% | 145% | 160% | 140% | 155% | 170% | 150% | 165% | 180% |
| 200001- | 140% | 155% | 170% | 150% | 165% | 180% | 160% | 175% | 190% |

TABLE 6

| Setting of Power distribution ratio according to Temperature Difference ΔT and Thermal History Cumulative Count | | | | | | | | | |
|---|---|---|---|---|---|---|---|---|---|
| | Pressure Roller Expected Temperature (deg) | | | | | | | | |
| | <90 deg Temperature Difference ΔT | | | 90-120 deg Temperature Difference ΔT | | | 120 deg≤ Temperature Difference ΔT | | |
| Cumulative Count | <0 deg | 0-20 deg | 20 deg ≤ | <0 deg | 0-20 deg | 20 deg ≤ | <0 deg | 0-20 deg | 20 deg ≤ |
| 0-110000 | 100% | 115% | 130% | 110% | 125% | 140% | 120% | 135% | 150% |
| 110001-220000 | 110% | 125% | 140% | 120% | 135% | 150% | 130% | 145% | 160% |
| 220001-330000 | 120% | 135% | 150% | 130% | 145% | 160% | 140% | 155% | 170% |
| 330001-440000 | 130% | 145% | 160% | 140% | 155% | 170% | 150% | 165% | 180% |
| 440001- | 140% | 155% | 170% | 150% | 165% | 180% | 160% | 175% | 190% |

For example, even if the predicted temperature of the pressure roller 22 is not changed, if the temperature difference ΔT is great, the power distribution ratio of the second heat generating resistor 102 with respect to the first heat generating resistor 101 may be set to a greater value as the durability count or the thermal history cumulative count is increased.

With respect to the first and the second exemplary embodiments, the time period during which the power distribution ratio of the second heat generating resistor with respect to the first heat generating resistor of the heater 16 is changed is from when the print signal is received until the recording material is conveyed to the nip portion Nt of the fixing apparatus 12.

If the heat distribution of the heater 16 in the longitudinal direction for preventing occurrence of paper crease of the recording material is employed, it may affect the fixing. To prevent the affect, the above time period is employed.

However, even if the above-described power distribution ratio is changed during the period from when the print signal is received until the recording material is conveyed to the nip portion Nt, if the amount of reverse crown of the pressure roller 22 cannot be set to an appropriate amount, the above-described power distribution ratio can be changed in the period where there is no paper passing through the nip portion Nt between the preceding recording material and the subsequent recording material.

Furthermore, if the appropriate amount of reverse crown of the pressure roller 22 cannot be obtained even if the above-described methods are implemented, the above-described power distribution ratio can be changed considering the balance with the fixing processing even if the fixing processing is being performed.

Figure 8A:
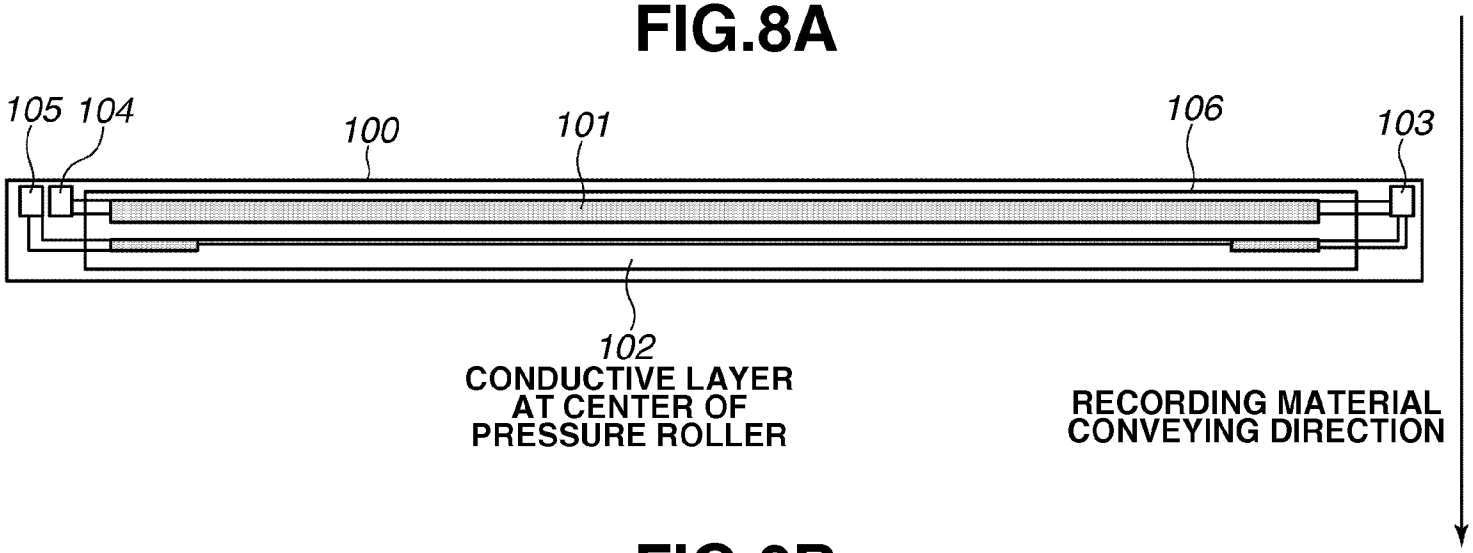
FIGS. 8A and 8B illustrate a configuration of a different heater of the fixing apparatus according to the first exemplary embodiment.
Figure 8B:
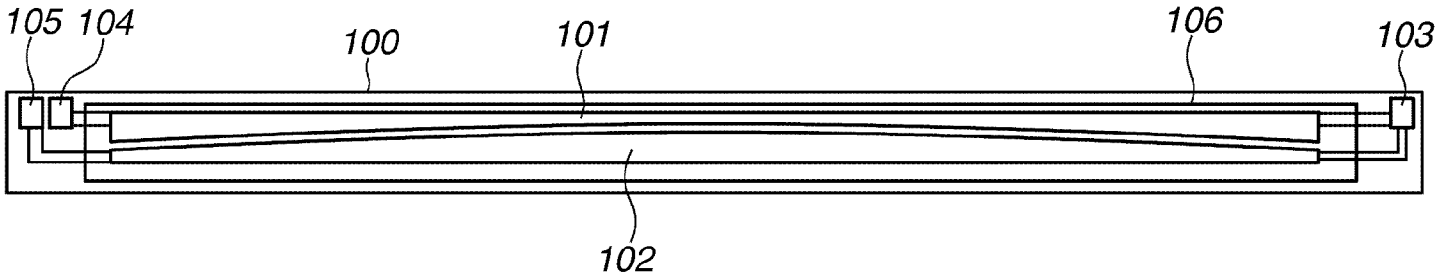

Further, the configuration of the heater 16 is not limited to the one illustrated in FIG. 4 according to the first exemplary embodiment. A different configuration can be used so long as the heat distribution at the center portion can be set at a greater value than the end portions by changing the heat distribution in the longitudinal direction of the heater 16. For example, as illustrated in FIGS. 8A and 8B, the heater 16 can include a first heat generating resistor with a greater amount of heat generation at the center portion than the end portions of the substrate in the longitudinal direction and a second heat generating resistor with a greater amount of heat generation at the end portions than the center portion of the substrate in the longitudinal direction.

Further, the main thermistor 18 of the heater 16 may detect the temperature of the center portion or a portion in the vicinity of the center portion in the longitudinal direction of the film 20 instead of detecting the temperature of the substrate 100 of the heater 16. In other words, the main thermistor 18 may detect the temperature of the film 20 and the sub-thermistors 19*a* or 19*b* may detect the temperature of the heater 16.

According to the first and the second exemplary embodiments, a pressure roller 222 having two rubber layers at the outer periphery of a metal core 222*c*, such as the one illustrated in FIG. 11, can be used as the pressure roller. The two rubber layers are a first rubber layer 222*f* and a second rubber layer 222*a* having a higher thermal conductivity than the first rubber layer 222*f*. Further, a surface layer 222*b* is formed on the second rubber layer 222*a*.

In order to increase thermal conductivity, the second rubber layer includes heat conductive filler. Further, a solid rubber or a foamed rubber will be used for the first rubber layer.

The merit of using the pressure roller 222 having two rubber layers with different thermal conductivity according to the present exemplary embodiment will be described.

The second rubber layer has a small heat capacity and good thermal conductivity. Thus, the temperature of the second rubber layer is quickly increased. The thermal conductivity of the first rubber layer is lower than the second rubber layer and the temperature increase is slower.

Thus, the merit of employing the pressure roller 222 is to obtain the elasticity necessary in fixing the image at the nip portion Nt and quickly expanding the outside diameter of the pressure roller 222 when the surface of the pressure roller 222 is heated via the film according to the change in the heat distribution of the heater 16.

Since the pressure roller 222 is deformed into the appropriate reverse crown shape before the recording material is conveyed to the nip portion, the occurrence of the paper crease can be prevented without affecting the fixing ability.

Further, if the cumulative number of sheets that have passed through the nip portion Nt of the fixing apparatus 12 is great or if the thermal history cumulative count is great, as described above, the difference in the outside diameter of the pressure roller 22 at the center portion and the end portions in the longitudinal direction will be small and the amount of reverse crown is reduced.

However, if small size recording materials with a narrow width are continuously conveyed, the temperature of the end portions of the pressure roller 22 in the longitudinal direction is increased due to the effect of the temperature rise at the non-sheet-passing portion. Accordingly, the outside diameter will be equal to or greater than a size of a new pressure roller, and the possibility of the paper crease may be reduced.

Thus, immediately after small size recording materials are continuously conveyed, if a recording material with a wider width is conveyed, it is not necessary to use the settings of the power distribution ratio according to the first and the second exemplary embodiments.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2012-018916 filed Jan. 31, 2012, which is hereby incorporated by reference herein in its entirety.

What is claimed is:

1. A fixing apparatus for fixing a toner image on a recording material while conveying the recording material bearing the toner image at a nip portion, the fixing apparatus comprising:

a cylindrical film;

a heater configured to heat the cylindrical film, the heater being capable of changing a heat distribution in a generatrix direction of the cylindrical film;

a pressure roller configured to form the nip portion between the cylindrical film and the pressure roller, the pressure roller including a region on which a diameter of the pressure roller is increased from a center portion toward an end portion;

a prediction unit configured to predict a temperature of the pressure roller; and a control unit configured to control the heater, wherein the pressure roller includes a metal core, a rubber layer formed outside the metal core and a surface layer, made of a tube, formed outside the rubber layer, and wherein the control unit controls the heater so that a ratio of an amount of heat generation at an end portion of the heater to an amount of heat generation at a center portion of the heater, during at least a part of a period from when a warm-up of the fixing apparatus is started until the recording material reaches the nip portion, in a case a temperature of the pressure roller, predicted by the prediction unit, is a first temperature when a warm-up of the fixing apparatus is started, is higher than the ratio in a case a temperature of the pressure roller, predicted by the prediction unit, is a second temperature, which is lower than the first temperature, when the warm-up of the fixing apparatus is started.

2. The fixing apparatus according to claim 1, wherein the ratio, in a case where a cumulative number of recording materials subjected to a fixing processing performed by the fixing apparatus is greater than a predetermined number, is greater than in a case where the cumulative number of the recording materials is less than the predetermined number.

3. The fixing apparatus according to claim 1, wherein the rubber layer includes a first rubber layer and a second rubber layer, which has a higher thermal conductivity than the first rubber layer, formed outside the first rubber layer.

4. A fixing apparatus for fixing a toner image on a recording material while conveying the recording material bearing the toner image at a nip portion, the fixing apparatus comprising:

a cylindrical film;

a heater configured to contact an inner surface of the cylindrical film, the heater being capable of changing a heat distribution in a generatrix direction of the cylindrical film; and a pressure roller configured to form the nip portion together with the heater via the cylindrical film, the pressure roller including a region on which a diameter of the pressure roller is increased from a center portion toward an end portion, a first temperature detection member configured to detect a temperature at the center portion of the heater or the cylindrical film in the generatrix direction of the cylindrical film;

a second temperature detection member configured to detect a temperature at the end portion of the heater in the generatrix direction of the cylindrical film; and a control unit configured to control the heater so that a temperature detected by the first temperature detection member is a target temperature, wherein the control unit performs a heater control so that a ratio of an amount of heat generation at the end portion of the heater to an amount of heat generation of the heater at the center portion of the heater, in a case where a difference value obtained by subtracting a temperature detected by the second temperature detection member from a temperature detected by the first temperature detection member is a first temperature when a warm-up of the fixing apparatus is started, is greater than in a case where the difference value is a second temperature lower than the first temperature, during at least a part of a period from when the warm-up of the fixing apparatus is started until the recording material reaches the nip portion.

5. The fixing apparatus according to claim 4, wherein changing the ratio is started at a time the warm-up of the fixing apparatus is started.

6. The fixing apparatus according to claim 4, wherein the pressure roller includes a metal core, a first rubber layer formed outside the metal core and a second rubber layer, which has a higher thermal conductivity than the first rubber layer, formed outside the first rubber layer.

7. A fixing apparatus for fixing a toner image on a recording material while conveying the recording material bearing the toner image at a nip portion, the fixing apparatus comprising:

a cylindrical film;

a heater configured to heat the cylindrical film, the heater being capable of changing a heat distribution in a generatrix direction of the cylindrical film;

a pressure roller configured to form the nip portion between the cylindrical film and the pressure roller, the pressure roller including a region on which a diameter of the pressure roller is increased from a center portion toward an end portion; and a control unit configured to control the heater, wherein the control unit controls the heater so that a ratio of an amount of heat generation at an end portion of the heater to an amount of heat generation at a center portion of the heater, during at least a part of a period from when a warm-up of the fixing apparatus is started until the recording material reaches the nip portion, is higher as a difference value obtained by subtracting a temperature on the end portion of the pressure roller from a temperature on the center portion of the pressure roller becomes larger when the warm-up of the fixing apparatus is started.

8. A fixing apparatus for fixing a toner image on a recording material while conveying the recording material bearing the toner image at a nip portion, the fixing apparatus comprising:

a rotatable member;

a pressure roller configured to form the nip portion between the rotatable member and the pressure roller, the pressure roller including a region on which a diameter of the pressure roller is increased from a center portion toward an end portion; and a control unit configured to control a temperature distribution of the rotatable member in a generatrix direction of the rotatable member, wherein the control unit controls a temperature of the rotatable member so that a ratio of a temperature on an end portion of the rotatable member to a temperature on a center portion of the rotatable member, during at least a part of a period from when a warm-up of the fixing apparatus is started until the recording material reaches the nip portion, in a case a difference value obtained by subtracting a temperature on the end portion of the pressure roller from a temperature on the center portion of the pressure roller is a first temperature when a warm-up of the fixing apparatus is started, is higher than the ratio in a case the difference value is a second temperature, which is lower than the first temperature, when the warm-up of the fixing apparatus is started.

9. A fixing apparatus for fixing a toner image on a recording material while conveying the recording material bearing the toner image at a nip portion, the fixing apparatus comprising:

a cylindrical film;

a heater configured to heat the cylindrical film;

a pressure roller configured to form the nip portion between the cylindrical film and the pressure roller, the pressure roller including a region on which a diameter of the pressure roller is increased from a center portion toward an end portion;

a temperature detection member configured to detect a temperature of the pressure roller; and a control unit configured to control a heat distribution of the heater in a generatrix direction of the cylindrical film, wherein the pressure roller includes a metal core, a rubber layer formed outside the metal core and a surface layer, made of a tube, formed outside the rubber layer, and wherein the control unit controls the heater so that a ratio of an amount of heat generation at an end portion of the heater to an amount of heat generation at a center portion of the heater, during at least a part of a period from when a warm-up of the fixing apparatus is started until the recording material reaches the nip portion, in a case a temperature of the pressure roller, detected by the temperature detection member, is a first temperature when a warm-up of the fixing apparatus is started, is higher than the ratio in a case a temperature of the pressure roller, detected by the temperature detection member, is a second temperature, which is lower than the first temperature, when the warm-up of the fixing apparatus is started.

* * * * *